United States Patent [19]

Kimura et al.

[11] 4,233,275

[45] Nov. 11, 1980

[54] PROCESS AND APPARATUS FOR PURIFYING RAW COAL GAS

[75] Inventors: Shoichi Kimura; Toshihiko Takahashi; Zensuke Tamura, all of Kudamatsu, Japan

[73] Assignee: Hitachi, Ltd., Tokyo, Japan

[21] Appl. No.: 965,512

[22] Filed: Dec. 1, 1978

[30] Foreign Application Priority Data

| | | | |
|---|---|---|---|
| Dec. 2, 1977 | [JP] | Japan | 52-143917 |
| Dec. 26, 1977 | [JP] | Japan | 52-156603 |
| Mar. 24, 1978 | [JP] | Japan | 53-33102 |

[51] Int. Cl.[3] ..... B01D 53/34

[52] U.S. Cl. ..... 423/230; 423/210; 423/231; 423/237; 423/245; 48/210

[58] Field of Search ..... 423/210 R, 210 S, 220, 423/215.5, 230, 231, 236, 237, 245 S; 48/210

[56] References Cited

U.S. PATENT DOCUMENTS

| | | | |
|---|---|---|---|
| 2,837,398 | 6/1958 | Grosskinsky et al. | 423/237 |
| 3,812,236 | 5/1974 | Adams et al. | 423/237 |
| 3,822,337 | 7/1974 | Wunderlich et al. | 423/224 |
| 4,089,809 | 5/1978 | Farrior et al. | 423/231 X |
| 4,155,990 | 5/1979 | Kimura et al. | 423/574 R |

OTHER PUBLICATIONS

Murthy, "Investigations on The Removal of Hydrogen Sulfide at High Temperature From Coal Gas", Paper Presented at 170th ACS Meeting, Chicago, Ill. Aug. 24–29, 1975.

Farrior et al., "Regenerable Iron Oxide–Silica Sorbents For the Removal of $H_2S$ From Hot Producer Gas", Presented at 4th Energy Resources Conference, Univ. of Kentucky, Lexington, Ky., Jan. 6–7, 1976.

*Primary Examiner*—Earl C. Thomas

*Attorney, Agent, or Firm*—Thomas E. Beall, Jr.

[57] ABSTRACT

A high temperature, high pressure raw coal gas containing hydrogen sulfide, ammonia, and tarry matter, is purified by contacting the raw coal gas with solid particles thereby cooling the raw coal gas to a temperature suitable for hydrogen sulfide removal and at the same time depositing the tarry matter onto the solid particles by condensation to recover the tarry matter from the raw coal gas, removing the hydrogen sulfide from the cooled and substantially tar-free coal gas, expanding the raw coal gas to a pressure suitable for ammonia decomposition, heating the expanded raw coal gas to a temperature suitable for ammonia decomposition by heat obtained by combusting the recovered tarry matter on the solid particles, thereby regenerating the solid particles for reuse, and then decomposing ammonia in the raw coal gas, thereby removing ammonia therefrom. A process for efficiently purifying raw coal gas by removing tarry matter, hydrogen sulfide and ammonia, including effectively utilizing the recovered tarry matter to produce heat while also effectively utilizing the energy obtained by expanding the coal gas through a pressure-reducing means such as an expansion turbine.

16 Claims, 7 Drawing Figures

PROCESS AND APPARATUS FOR PURIFYING RAW COAL GAS

This invention relates to a process and an apparatus for purifying a raw coal gas, and particularly to a process and an apparatus for purifying a high temperature, high pressure raw coal gas by removing tarry matters, hydrogen sulfide and ammonia contained in the raw coal gas.

It is the old art to produce a gaseous fuel comprising hydrogen, carbon monoxide, methane, etc. by gasification of fossil fuels.

Recently, there is renewed interest in using coal as an energy source as a substitute for petroleum, and power generation systems based on coal as a fuel source have been studied and developed. In the power generation system based on the coal as the fuel source it is essential for the economy and heat efficiency of a process to operate a gas turbine by combustion of a hot gaseous fuel produced by the gasification of coal while keeping the hot coal gas at the high temperature at which it is produced. However, sulfur and nitrogen naturally contained in the fossil fuel such as coal, etc. are converted to hydrogen sulfide and ammonia, respectively, at the gasification, and the gaseous fuel resulting from the gasification contains 1000 ppm to 2–3% each of hydrogen sulfide and ammonia, which offers a problem to the power generation system based on a coal gas as a fuel source.

Furthermore, the fossil fuel such as coal, etc. is not completely converted to low molecular weight gases such as carbon monoxide, hydrogen, etc. at the gasification of the fossil fuel, and various high molecular weight substances are produced and contained in the resulting raw gasification product gas (which will be hereinafter referred to as raw coal gas) in a state of molecules or mists. These ungasified high molecular weight substances are usually called tarry matter, and several ten percents of the feedstock fossil fuel may be converted to the tarry matter and contained in the raw coal gas when gasification conditions are not appropriate.

Hydrogen sulfide is a very corrosive gas, and acts as a serious environmental pollution source, and when the raw coal gas is combusted, the ammonia contained therein is converted to nitrogen oxides, and also is a serious environmental pollution source. Thus, both hydrogen sulfide and ammonia must be removed from the raw coal gas before combustion in a gas turbine to protect the gas turbine or related machinery from corrosion and eliminate a possible environmental pollution source.

As regards the tarry matter formed in the gasification of the fossil fuel, various components are contained at various concentrations in the raw coal gas, and thus have various dew points corresponding to the physical properties and concentration of each component. Whenever there is a decrease in temperature of a high temperature, high pressure raw coal gas before it is combusted in a gas turbine, the tarry matter condenses and deposits on pipes, apparatus, catalysts, etc., causing various troubles. Thus, development of techniques of removing hydrogen sulfide and ammonia as well as tarry matter from a high temperature, high pressure raw coal gas has been keenly desired as a key for success in the power generation system using coal as a fuel source.

The removal of hydrogen sulfide from a high temperature, high pressure raw coal gas is not limited only to the fuel gas from coal as the raw material, but is required in the wide field of the gas fuel and chemical industries. However, the desulfurization of high temperature, high pressure raw coal gas is regarded as very difficult.

In the removal of hydrogen sulfide from a raw coal gas at a high temperature under a high pressure a dry process based on a solid desulfurizer having granular shapes has been so far regarded as effective, and the processes using calcium carbonate, dolomites, iron oxide, etc. as a desulfurizer are known. Among these desulfurizers, iron oxide is regarded as best in the percent hydrogen sulfide removal, regeneration of deactivated desulfurizer, and economy (Keshava S. Murthy: "Investigation of the removal of hydrogen sulfide at high temperature from coal gas", papers presented at the Symposium on Coal Gasification, Division of Fuel Chemistry, 170th ACS National Meeting, Chicago, Ill., USA, Aug. 24–29, 1975; W. L. Farrior et al: "Regenerable iron oxide-silica sorbents for the removal of $H_2S$ from hot producer gas", papers presented at the fourth Energy Resources Conference, University of Kentucky, Lexington, Ky., U.S.A., Jan. 6–7, 1976; U.S. Pat. No. 3,822,337; U.S. Patent Application Ser. No. 771,911).

Iron oxide reacts with hydrogen sulfide at an elevated temperature in a reducing atmosphere, i.e. in the presence of hydrogen, to form iron sulfide according to the following equation (1).

$$Fe_2O_3+2H_2S+H_2 \rightarrow 2FeS+3H_2O \quad (1)$$

Iron oxide, once converted to iron sulfide, loses the capacity to remove hydrogen sulfide, and thus it is necessary to revive the capacity of removing hydrogen sulfide by regeneration. Regeneration of iron sulfide is carried out by contacting iron sulfide with air or air mixed with steam to return the iron sulfide to iron oxide while bi-producing sulfur dioxide and hydrogen sulfide as a gas according to the following equations (2) and (3).

$$4FeS+7O_2 \rightarrow 2Fe_2O_3+4SO_2 \quad (2)$$

$$2FeS+3H_2O \rightarrow Fe_2O_3+2H_2S+H_2 \quad (3)$$

However, in the removal of hydrogen sulfide by iron oxide, the reaction of the foregoing equation (1) is an exothermic reaction, and if the reaction temperature is too high, a concentration of remaining hydrogen sulfide is increased according to a chemical equilibrium, whereas, if the reaction temperature is too low, the concentration of remaining hydrogen sulfide is decreased according to the chemical equilibrium, but the reaction rate itself is lowered, and thus a considerable amount of iron oxide is required to remove hydrogen sulfide with a good percent removal. Thus, it is necessary to control the reaction temperature to an optimum range in view of allowable concentration of remaining hydrogen sulfide. This relation will be described in detail below, referring to FIG. 1 of the accompanying drawings.

In the accompanying drawings,

FIG. 4 is a flow diagram showing another embodiment of the invention similar to FIG. 3, wherein a portion of the combustible gas contained in the desulphirized raw gas is combusted to elevate the temperature of the raw gas prior to ammonia decomposition.

Figure 3:
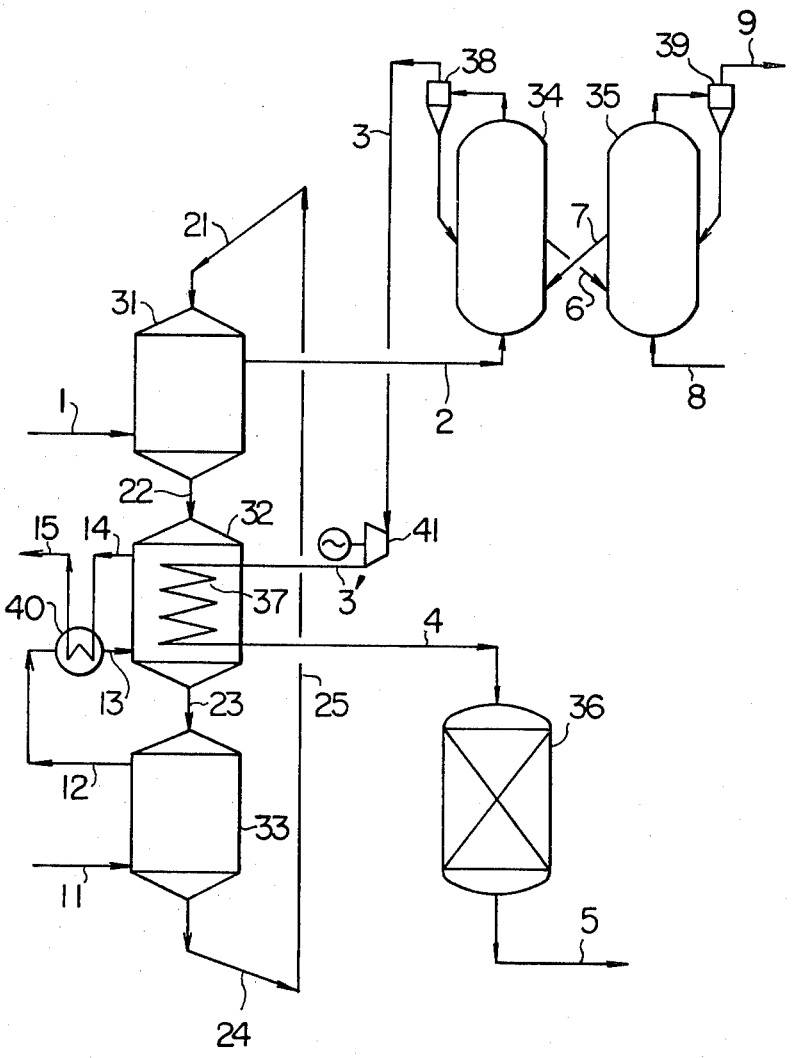
FIG. 3 is a flow diagram showing one embodiment of purification of a high temperature, high pressure raw coal gas according to the present invention.
Figure 5:
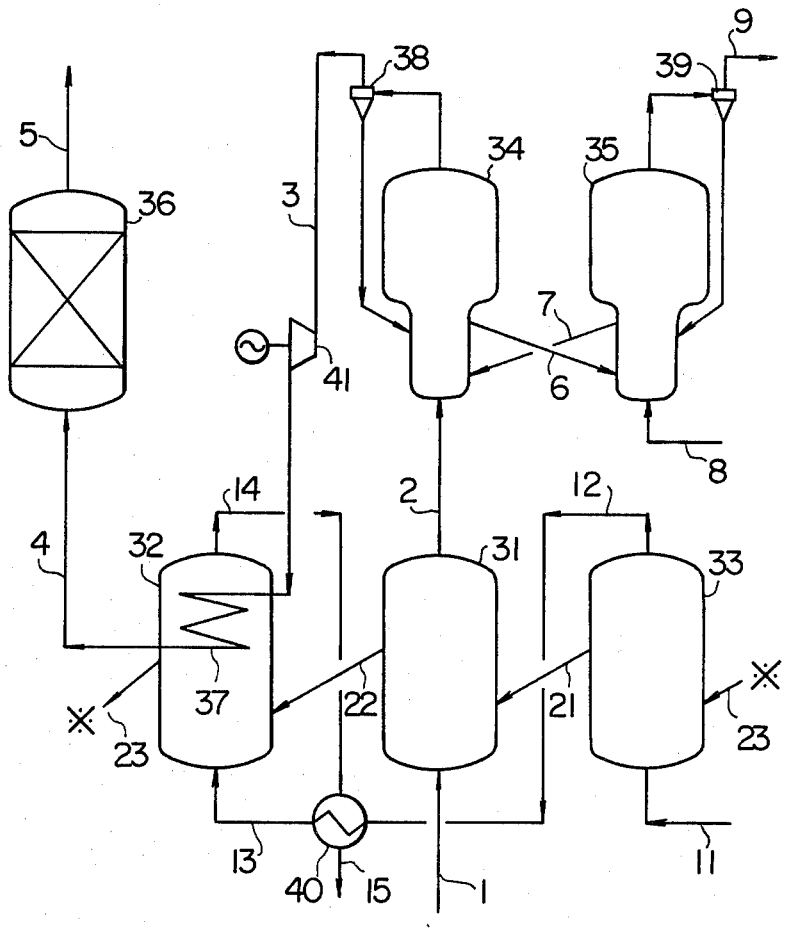

FIG. 5 is a flow diagram showing another embodiment of the invention similar to FIG. 3, wherein the tar remover 31, the tar combustor 32 and the cooler 33 are fluidized bed type units.

Figure 4:
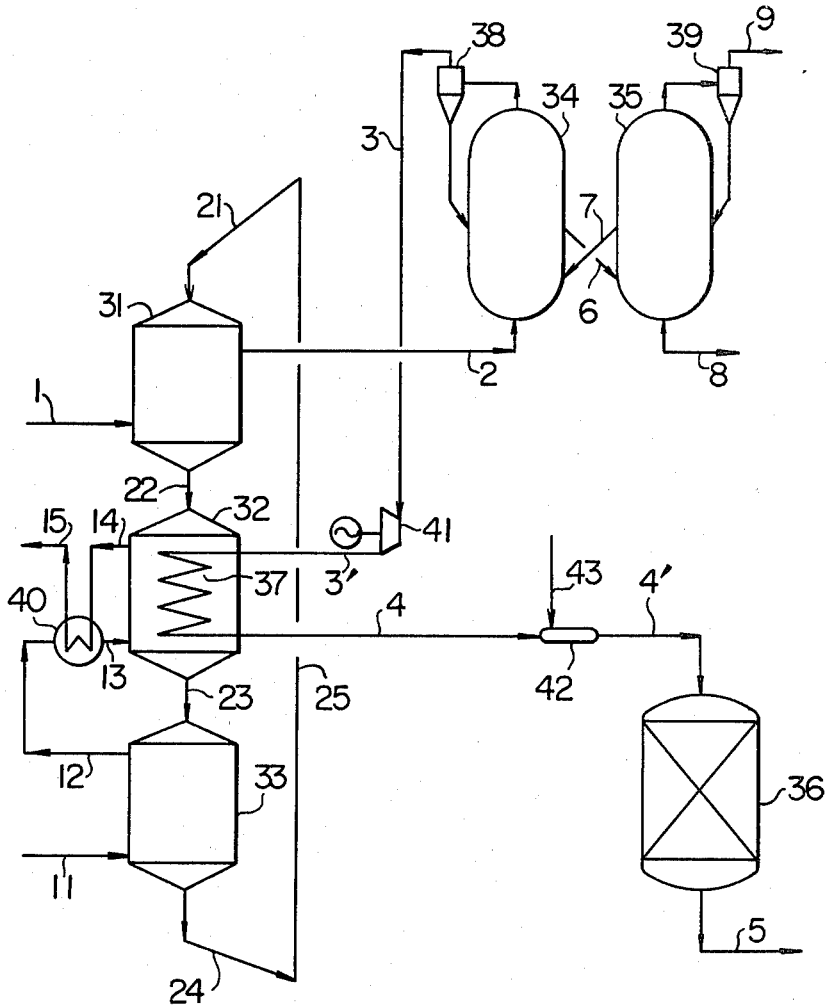
FIGS. 4 to 7 are flow diagrams showing other embodiments of the present invention.
Figure 6:
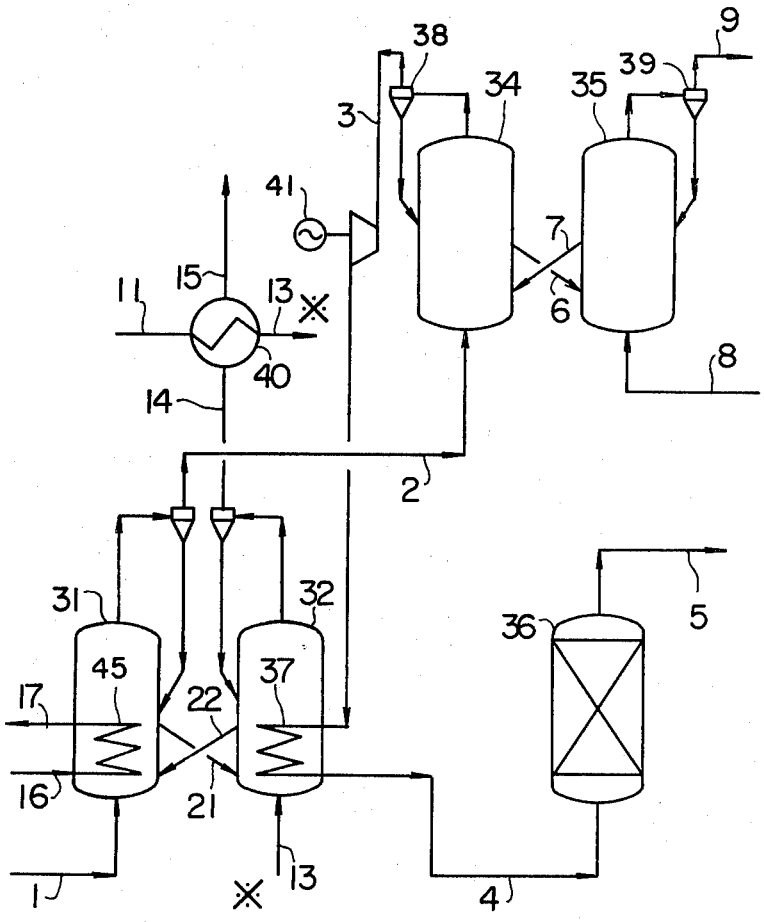

FIG. 6 is a flow diagram showing another embodiment of the invention, wherein raw coal gas in tar remover 31 is cooled to a greater degree than in FIGS. 3–5 in order to remove more tarry matter.

Figure 7:
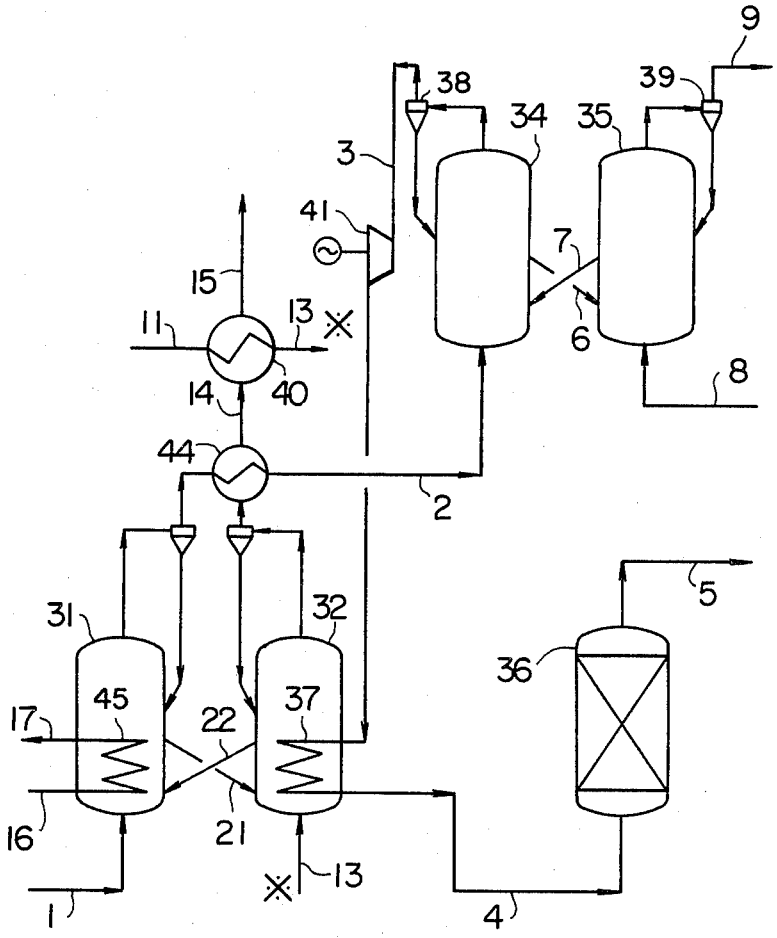

FIG. 7 is a flow diagram of another embodiment of the invention similar to FIG. 6, wherein the cooled raw coal gas leaving tar remover 31 is heated to a temperature suitable for hydrogen sulfide removal.

Figure 1:
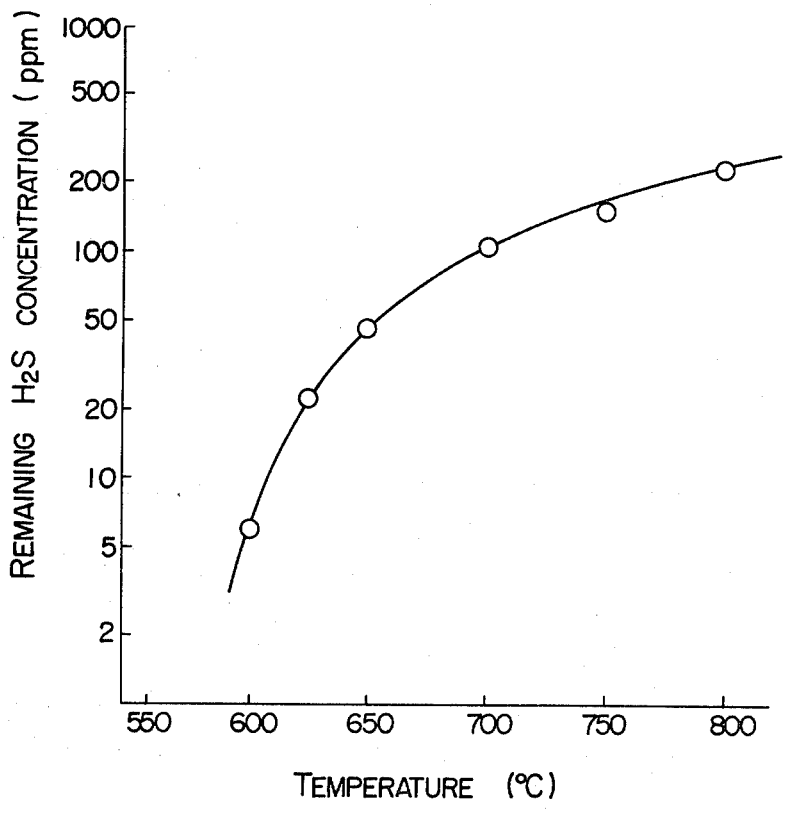
FIG. 1 is a diagram showing a relation between reaction temperatures for hydrogen sulfide removal and concentrations of remaining hydrogen sulfide.

In FIG. 1, the dependency of removal of hydrogen sulfide by iron oxide on temperature is shown, where concentrations of remaining hydrogen sulfide found when a raw coal gas having the composition shown in the following Table 1 were contacted with an iron oxide absorber at various temperatures.

The raw coal gas leaving a coal gasification furnace is usually at a temperature of 800° to 900° C., but hydrogen sulfide remains at a considerable concentration after the reaction of removal of hydrogen sulfide at such a high temperature, and thus it is necessary to conduct the reaction at about 650° C. to suppress the concentration of remaining hydrogen sulfide to about 50 ppm.

TABLE 1

| Components | $N_2$ | CO | $CO_2$ | $H_2$ | $H_2O$ | $CH_4$ | $NH_3$ | $H_2S$ |
|---|---|---|---|---|---|---|---|---|
| Concentration (% by volume) | 43.5 | 15.0 | 8.0 | 14.0 | 10.0 | 8.0 | 1.0 | 0.5 |

Thus, the reaction temperature for the removal of hydrogen sulfide by iron oxide is about 550° to about 800° C., preferably about 600° to about 750° C., more preferably about 650° C.

As regards decomposition and removal of ammonia from a high temperature, high pressure raw coal gas, it is known to decompose ammonia especially in an ammonia plant effluent gas by a catalyst of iron system (iron oxide) (U.S. Pat. No. 3,812,236), but the ammonia decomposition and removal are very difficult in the case of a gas containing many components, especially, catalyst-poisoning components such as hydrogen sulfide, etc., such as a raw coal gas.

In the decomposition of ammonia contained in a raw coal gas, it is most preferable that hydrogen sulfide is removed by iron oxide at first, and then ammonia is decomposed through contact with a catalyst containing iron oxide, preferably a catalyst containing iron in a state of reduced iron, prepared by once reducing a catalyst containing iron oxide as a main component. The decomposition of ammonia by a reduced iron catalyst can be represented as follows:

$$2NH_3 \xrightarrow{Fe} N_2 + 3H_2 \quad (4)$$

$$2xFe + 2NH_3 \rightarrow 2FexN + 3H_2 \quad (5)$$

$$2FexN \rightarrow 2xFe + N_2 \quad (6)$$

However, the decomposition of ammonia represented by the foregoing reaction equations is an endothermic reaction, and thus a decomposition efficiency is increased according to the chemical equilibrium if the reaction temperature is higher, and consequently the concentration of remaining ammonia is lowered. That is, the reaction of ammonia decomposition can proceed more effectively, if the reaction temperature becomes higher, in contrast to the reaction of the removal of hydrogen sulfide.

On the other hand, in the reaction of ammonia decomposition shown by the equation (4), total 4 gaseous molecules, that is, one nitrogen molecule and 3 hydrogen molecules, are formed from two ammonia molecules, that is, the number of molecules is increased as a result of the reaction, and thus the concentration of remaining ammonia is increased according to the chemical equilibrium with increasing pressure on the reaction to decompose ammonia.

Figure 2:
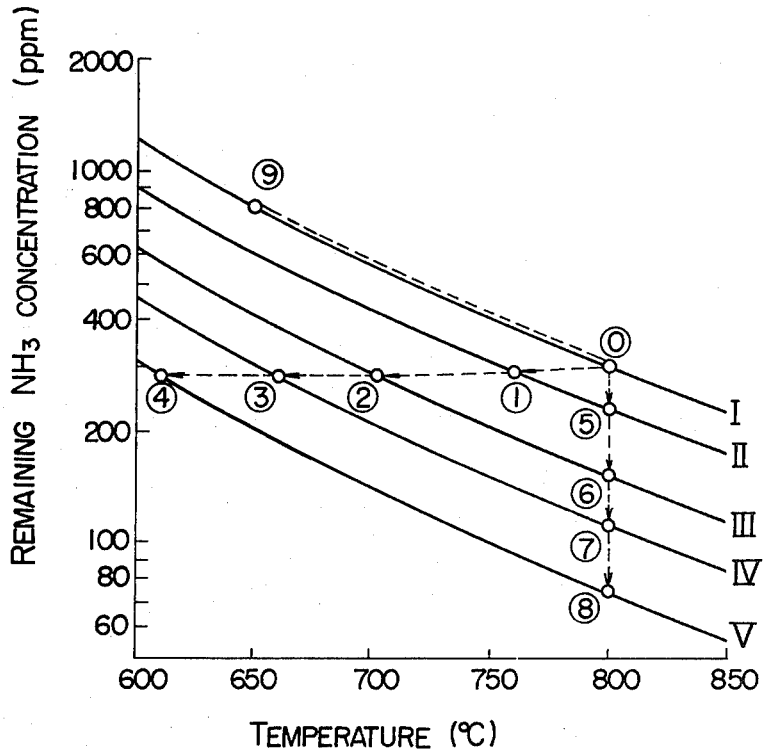
FIG. 2 is a diagram showing a relation among ammonia decomposition pressures and temperatures, and concentrations of residual ammonia.

In FIG. 2, concentrations of remaining ammonia according to the reaction equilibrium are shown when a raw coal gas containing 10,000 ppm ammonia is contacted with a catalyst containing iron in a state of reduced iron at various temperatures and pressures, where an effect of temperature and pressure upon the ammonia decomposition is indicated, as will be described in detail later.

On the other hand, in the gasification of coal, etc., it is necessary to make the gasification pressure as high as possible to increase the calorific efficiency represented by the ratio of the calorific value obtained by combusting a gas fuel resulting from gasification to a calorific value obtained by directly combusting the feedstock coal. The gasification is usually operated under a pressure of about 20 kg/cm$^2$. However, it is necessary to desulfurize the raw coal gas prior to the ammonia decomposition, as described earlier, to prevent the poisoning of the ammonia decomposition catalyst by hydrogen sulfide. The desulfurization reaction is carried out most preferably at about 650° C., where the effective removal of hydrogen sulfide can be attained at the effective reaction rate. If the effluent coal gas from the desulfurization step is directly led to the succeeding ammonia decomposition, the reaction conditions for the ammonia decomposition will be such that a temperature is 650° C. and a pressure is as high as 20 kg/cm$^2$. When the ammonia decomposition is carried out under such reaction conditions, the concentration of remaining ammonia after the ammonia decomposition will be as high as about 810 ppm, as is shown by curve I, point (9) in FIG. 2.

As described above, when hydrogen sulfide and ammonia in a raw coal gas at a high temperature under a high pressure are removed and decomposed with an absorber of, or containing iron oxide and a catalyst containing iron in a state of reduced iron, respectively, these cannot be removed with satisfactory efficiencies at the same time owing to the contradicting temperature dependencies between the hydrogen sulfide removal reaction and the ammonia decomposition reaction. This has been a serious problem.

Furthermore, in order to prevent the ammonia decomposition catalyst from any poisoning by the remaining hydrogen sulfide after the hydrogen sulfide removal by the absorber containing iron oxide prior to the ammonia decomposition, it is preferable to make the ammonia decomposition reaction temperature higher than the hydrogen sulfide removal temperature. Thus, an appropriate ammonia decomposition temperature by the catalyst containing iron in a state of reduced iron is about 700° to about 900° C., where about 900° C. is an upper limit when a precaution for sintering of the catalyst is taken into account.

Generally, a raw coal gas resulting from the coal gasification leaves a gasification furnace at a temperature of about 800° C. to about 900° C. under a pressure of about 20 kg/cm$^2$. For the foregoing reasons, it will be the most appropriate means for obtaining the most efficient desulfurization and ammonia removal that the hydrogen sulfide removal by the absorber of, or containing iron oxide is carried out after the raw coal gas temperature is lowered to about 650°, and the ammonia decomposition by a catalyst containing iron in a state of reduced iron is carried out after the desulfurized coal gas is expanded to reduce its pressure and heated to elevate the temperature. However, in lowering the temperature of the raw coal gas for the removal of hydrogen sulfide, some components of the tarry matter in the raw coal gas are condensed in a mist form, whenever cooled to their dew points, and start to deposit on the hydrogen sulfide absorber particles of, or containing iron oxide, and cover the surfaces of the absorber particles, not only lowering the desulfurization capacity of the absorber, but also causing cloggings in pipings, etc. It requires an additional heating source from the outside and additional expenses to heat the once cooled raw coal gas to a temperature suitable for ammonia decomposition.

An object of the present invention is to overcome these problems and provide a process and apparatus for purifying a high temperature, high pressure raw coal gas, without any trouble due to the deposition of tarry matter and any additional heating source from the outside, under the most effective conditions for reaction temperature and pressure for the hydrogen sulfide and ammonia removal.

The present invention has been established as a result of detailed studies of reactions to remove hydrogen sulfide and ammonia from a high temperature, high pressure raw coal gas, and overall studies of a coal gasification-power generation system. The desulfurization and ammonia decomposition of a high temperature, high pressure raw coal gas are carried out under the most effective conditions for the operation of gas turbine based on combustion of the coal gas.

That is, the present invention is characterized by cooling a high temperature, high pressure raw coal gas containing hydrogen sulfide, ammonia and tarry matter to a temperature suitable for the reaction to remove hydrogen sulfide through contact with solid particles, thereby simultaneously condensing, depositing and recovering the tarry matter on the solid particles, then removing hydrogen sulfide in the raw coal gas by reaction with an absorber of, or containing iron oxide, then pressure-reducing the coal gas by expansion and recovering the energy possessed by the raw coal gas as a power, heating the desulfurized and expanded coal gas by the heat of combustion, obtained by burning the tarry matter recovered on the solid particles, to a temperature suitable for ammonia decomposition reaction, then decomposing ammonia in the raw coal gas through contact with a catalyst containing iron in a state of reduced iron, and reusing the solid particles regenerated by the combustion of the tarry matter to recover the tarry matter.

The present invention will be described in detail below, referring to embodiments:

A low calorific value raw coal gas for power generation produced by the gasification of coal has, for example, a composition given in Table 2, and a temperature of 800° C. and a pressure of 20 kg/cm$^2$ at the outlet of a gasification furnace.

TABLE 2

| Component | $N_2$ | CO | $H_2$ | $H_2O$ | $CO_2$ | $CH_4$ | $NH_3$ | $H_2S$ | Total |
|---|---|---|---|---|---|---|---|---|---|
| Concentration (% by volume) | 53.0 | 11.8 | 11.1 | 10.2 | 6.5 | 6.2 | 0.8 | 0.4 | 100.0 |

Tarry matter: 32g/Nm$^3$
Dust: 2g/Nm$^3$

The tarry matter contained in the raw coal gas at the outlet of the gasification furnace are mostly in a mist state, and when the raw coal gas leaving the gasfication furnace is continuously contacted with solid particles, for example, alumina particles at a lower temperature than the raw coal gas temperature at the outlet of the gasification furnace, the raw coal gas temperature is lowered to 650° C., whereby about 60% of the tarry matter contained in the raw coal gas is removed therefrom by condensation and deposition on the alumina particles, and only uncondensed tarry matter having dew points of lower than 650° C. remain in a gaseous molecular state in the effluent coal gas. After the raw coal gas has been subjected to the temperature lowering and removal of the tarry matter, the raw coal gas is contacted with solid absorber particles of, or containing iron oxide, and more than 99% of hydrogen sulfide in the raw coal gas is removed thereby, while the temperature of the effluent raw coal gas is slightly elevated due to the heat of reaction between the iron oxide and hydrogen sulfide. Since there is no temperature lowering in the hydrogen sulfide removal step by iron oxide, the tarry matter is no longer condensed and deposited on the solid absorber particles.

The raw coal gas freed from hydrogen sulfide is then led to a pressure-reducing means, for example, an expansion turbine, and expanded to a lower pressure. The energy obtained by the expansion of the raw coal gas generates power through the expansion turbine.

The alumina particles with the tarry matter condensed and deposited thereon are taken to a burning furnace, and burned therein with hot air and the hydrogen sulfide-freed, expanded raw coal gas is heated by the heat of combustion of said tarry matters through a heating pipe provided in the burning furnace, whereby the temperature of the raw coal gas is elevated to 800° C. The raw coal gas thus heated to 800° C. is then passed through a bed of catalyst containing iron in a state of reduced iron, whereby 99.5% of ammonia in the raw coal gas is decomposed. Since no temperature lowering of the crude gas takes place, the tarry matter in the raw coal gas is no longer condensed. That is, the tarry matter is not deposited on the ammonia decomposition catalyst.

The coal gas freed from ammonia by decomposition, that is, clean gas, is led to a combustor of a gas turbine and combusted with air therein, producing a high temperature, high pressure, turbine-driving gas. The combustion gas drives the gas turbine and leaves the gas turbine as a high temperature flue gas, which is usually led to a waste heat boiler to recover the waste heat therefrom.

The alumina particles with the tarry matter thereon are completely freed from the tarry matter by the burning of the tarry matters with the hot air, and regenerated. After cooling with air, the regenerated alumina particles are reused to recover the tarry matter from the raw coal gas and cool the raw coal gas again.

Solid particles comprising a mixture of alumina and silica can be also used with an equivalent effect in place of the alumina particles.

When a coal gas at 800° C. having the same composition as shown in Table 2 is contacted with the alumina particles in a vessel provided with a cooling pipe, through which cooling water is passed to lower the temperature of the effluent raw coal gas to 635° C., more than 60% of the tarry matter contained in the raw coal gas is condensed and deposited onto the alumina particles, and only the uncondensed tarry matter having dew points of less than 635° C. remain likewise in a gaseous molecular state. The raw coal gas freed from the condensed tarry matter is then contacted with solid absorber particles containing iron oxide, whereby more than 99% of hydrogen sulfide is removed from the raw coal gas, and the temperature of the raw coal gas is slightly elevated due to the heat of reaction between the iron oxide and hydrogen sulfide. The tarry matter is no longer deposited on the solid absorber particles.

The tarry matter condensed and deposited on the alumina particles are burned to heat the raw coal gas after the desulfurization and expansion in the same manner as above, whereby a raw coal gas having a temperature of 800° C. can be obtained. Then, the raw coal gas is contacted with a catalyst containing iron in a state of reduced iron, and more than 99% of ammonia is decomposed. The tarry matter is no longer deposited on the ammonia decomposition catalyst.

The alumina particles with the tarry matter condensed and deposited thereon are regenerated by the burning of the tarry matter, and can be reused to recover the tarry matter from a raw coal gas.

The heat of combustion of the tarry matter recovered by the alumina particles amounts to 7,000–10,000 Kcal/kg. Thus, the necessary amount of the tarry matter for elevating the temperature of a raw coal gas of 635°–650° C. after the removal of hydrogen sulfide to 800° C. is 6–8 g/Nm$^3$ of the raw coal gas. Thus, about 20% of the tarry matter in the raw coal gas leaving the gasification furnace is to be burned to heat the raw coal gas leaving the hydrogen sulfide removal step. Actually, about 60% of the tarry matter can be recovered, and thus the remaining heat of combustion can be effectively utilized in other fields.

The present invention will be described in detail below, referring to embodiments shown in the accompanying drawings. Similar elements in the drawings have been given the same number.

In FIG. 3, a flow diagram of one embodiment of the present invention based on the foregoing principle of the present invention is given, where a raw coal gas 1 leaving a gasification furnace (not shown in the drawing) enters into a tar remover 31, wherein the raw coal gas is cooled to a temperature suitable for hydrogen sulfide removal reaction and at the same time the tarry matter contained in the raw coal gas is recovered on alumina particles placed in the tar remover by condensation and deposition, and removed. Then, the raw coal gas freed from the tarry matter is led to a desulfurizer reactor 34 through a line 2, and contacted with solid absorber particles of iron oxide or solid absorber particles containing iron oxide supported on alumina in a fluidized bed state therein and hydrogen sulfide is removed from the raw coal gas through reaction with iron oxide. The raw coal gas leaves the desulfurizer reactor as a desulfurized raw coal gas 3.

Fine particles entrained in the raw coal gas 3 are separated and removed in a cyclone 38, and returned to the desulfurizer reactor 34. The raw coal gas 3 leaving the desulfurization step is pressure reduced by expansion in an expansion turbine 41, and then led to a heating tube 37 in a tar combustor 32. The tar remover 31 is of a moving bed type, and alumina particles having a lower temperature than that of the raw coal gas 1 are supplied to the tar remover 31 at its top through a line 21 to cool the raw coal gas 1 to a temperature suitable for the hydrogen sulfide removal and simultaneously recover the tarry matter contained in the raw coal gas 1 on the alumina particles by condensation and deposition. The alumina particles with the tarry matter recovered thereon leave the tar remover 31 at its bottom through a line 22 and enter into the tar combustor 32, where the tarry matter on the alumina particles is burned with hot air supplied through a line 13 to heat the raw coal gas 3 leaving the desulfurization step through a heating pipe 37. The alumina particles removed from the tarry matter by burning move successively downwards in the tar combustor 32 and enter into a cooler 33 through a line 23. In the cooler 33 the alumina particles removed from the tarry matter are cooled with air 11 supplied at the ambient temperature while being successively moved downwards, leave the cooler at its bottom and are returned to the tar remover 31 through lines 24 and 25.

The raw coal gas 4 heated to a temperature suitable for ammonia decomposition reaction through the absorption of the heat of combustion of the tarry matter through the heating pipe 37 is led to an ammonia decomposition reactor 36, and contacted with an ammonia decomposition catalyst containing iron in a state of reduced iron prepared by reducing iron oxide-supporting alumina by hydrogen, and ammonia contained in the raw coal gas is decomposed to produce a clean gas 5.

On the other hand, the air 11 for cooling the alumina particles after the burning of the tarry matter is heated by the alumina particles, leaves the cooler 33 through a line 12, is heated in a heater 40 by an effluent combustion gas 14 from the tar combustor 32, and enters into the tar combustor 32 through a line 13 to burn the tarry matter on the alumina particles. Then, the effluent combustion gas leaving the tar combustor 32 through a line 14 heats the air 12, and leaves the system as a flue gas 15.

The absorber particles whose iron oxide is converted to iron sulfide through the reaction with hydrogen sulfide in the desulfurizer reactor 34 are through line 6 to a regenerator reactor 35, where the iron sulfide is oxidized with air or air mixed with steam as a regenerating gas 8 in a fluidized bed state and regenerated to iron oxide. The regenerated absorber particles are returned to the desulfurizer reactor 34 through a line 7. Fine absorber particles entrained in the effluent regenerating gas leaving the regenerator reactor 35 are recovered in a cyclone 39 and returned to the reactor 35, before the regenerating gas leaves the system through line 9. In the embodiment of the present invention shown in the flow diagram of FIG. 3, where a raw coal gas having the composition shown in Table 2 at a temperature of 800° C. under a pressure of 20 kg/cm$^2$ is used as a raw gas 1, one operating example is such that the raw coal gas in line 2 after the removal of the tarry matter enters into the desulfurizer reactor 34 at 650° C., leaves it at about 650° C. at a concentration of remaining hydrogen sulfide of less than 40 ppm in the raw coal gas 3, that is, more than 99% of hydrogen sulfide is removed; the raw coal gas 3 is reduced to the atmospheric pressure by the expansion turbine 41, heated to 810° C. by the heat of combustion of the tarry matter, led to the ammonia decomposition reactor 36, and leaves the reactor 36 as a clean gas 5 at 800° C. at a concentration of remaining ammonia of less than 45 ppm in the clean gas, that is, more than 99% of ammonia is decomposed.

When the raw coal gas 3 is expanded in the expansion turbine 41, a slight temperature lowering takes place together with the pressure reduction. The temperature lowering depends upon an expansion ratio of the raw coal gas 3 to the expanded raw coal gas 3' by the expansion turbine 41. That is, the temperature of the raw coal gas 4 obtained by passing the expanded raw coal gas 3' through the heating pipe 37 to be heated by the combustion of the tarry matter in the tar combustor 32 is influenced by the expansion ratio by the expansion turbine 41. Furthermore, the ammonia decomposition reaction is governed by both temperature and pressure of the raw coal gas 4, and thus, the concentration of remaining ammonia in the clean gas 5, that is, the concentration of undecomposed ammonia given according to the chemical equilibrium when the raw coal gas 4 is passed through the ammonia decomposition reactor 36 filled with the catalyst containing iron in a state of reduced iron, depends upon an expansion ratio of raw coal gas 3 to expanded raw coal gas 3' by the expansion turbine 41.

This relation will be described in detail below by way of the embodiment of FIG. 3, using the raw coal gas of Table 1.

In Table 3, results of measuring the temperature and pressure of raw coal gas 3' and 4 and the clean gas 5 and the concentration of remaining ammonia in the clean gas 5 while changing the expansion ratio of the raw coal gas 3 to the expanded coal gas 3' by the expansion turbine 41 are shown.

As shown in Table 3, the concentrations of remaining ammonia are below 300 ppm between the expansion ratios of 1.3–4.

The relation will be more clear, if reference is made to the diagram of FIG. 2.

In FIG. 2, Curve I shows a relation between the ammonia decomposition temperature and the concentration of remaining ammonia under a pressure of 20 kg/cm$^2$, Curve II under 15 kg/cm$^2$, Curve III under 10 kg/cm$^2$, Curve IV under 7.5 kg/cm$^2$, and Curve V under 5 kg/cm$^2$.

In FIG. 2, point (0) shows the concentration of remaining ammonia when the ammonia decomposition is carried out under the outlet conditions of the raw coal gas from the gasification furnace (20 kg/cm$^2$, 800° C.) According to the conventional art, the raw coal gas must be cooled to a temperature suitable for the hydrogen sulfide removal while keeping the pressure under 20 kg/cm$^2$. That is, the raw coal gas at 800° C. is cooled along Curve I in FIG. 2 to point (9), 650° C., necessary for the hydrogen sulfide removal, at which the concentration of remaining ammonia after the ammonia decomposition reaction is as high as 810 ppm.

On the other hand, in the present invention, the raw coal gas is adiabatically expanded to perform work, whereby both the pressure and the temperature are lowered, and the expanded raw coal gas is reheated to a temperature suitable for the ammonia decomposition reaction by passing through heating pipe 37 in the tar combustor 32. Thus, the concentration of remaining ammonia after the ammonia decomposition reaction changes from Curve I to Curve II, Curve III, Curve IV, and Curve V in FIG. 2, resulting in the concentrations of remaining ammonia defined at points (1), (2), (3) and (4), each corresponding to Run No. 1, 2, 3 and 4 in Table 3. Each point is below 300 ppm, which means that ammonia remains at only about one-third of the concentration of the conventional art shown by point (9)

TABLE 3

| Run No. | Expansion ratio | Condition | Line No. 3 | 3' | 4 | 5 |
|---|---|---|---|---|---|---|
| | | Pressure (kg/cm$^2$) | 20 | 15 | 15 | 15 |
| 1 | 1.33 | Temperature (°C.) | 653 | 606 | 756 | 756 |
| | | $NH_3$ (ppm) | 10,000 | 10,000 | 10,000 | 292 |
| | | Pressure (kg/cm$^2$) | 20 | 10 | 10 | 10 |
| 2 | 2.0 | Temperature (°C.) | 653 | 544 | 694 | 694 |
| | | $NH_3$ (ppm) | 10,000 | 10,000 | 10,000 | 290 |
| | | Pressure (kg/cm$^2$) | 20 | 7.5 | 7.5 | 7.5 |
| 3 | 2.67 | Temperature (°C.) | 653 | 505 | 655 | 655 |
| | | $NH_3$ (ppm) | 10,000 | 10,000 | 10,000 | 289 |
| | | Pressure (kg/cm$^2$) | 20 | 5.0 | 5.0 | 5.0 |
| 4 | 4.0 | Temperature (°C.) | 653 | 455 | 605 | 605 |
| | | $NH_3$ (ppm) | 10,000 | 10,000 | 10,000 | 290 |

In FIG. 4, another embodiment of the present invention is shown, which is different from the embodiment of FIG. 3 only in the following points. After the desulfurization, expansion, and heating in the tar combustor, the raw coal gas 4 is admixed with air 43 at an oxidation heater 42, where a portion of combustible gas contained in the raw coal gas 4 is combusted by oxidation to further elevate the temperature of the raw coal gas to provide a coal gas 4' having a more suitable condition for the ammonia decomposition, and then the resulting coal gas 4' enters in the ammonia decomposition reactor 36. The amount of air 43 to be added to the raw coal gas 4 is adjusted in view of the temperature of the raw coal gas 4 and the ammonia decomposition temperature, and is also limited to a range that can satisfy the minimum requirement for the combustible gas proportion imposed when the clean gas is combusted in a combustor (not shown in the drawing) after the ammonia decomposition to make a high temperature, high pressure combustion gas for driving a gas turbine (not shown in the drawing).

In Table 4, results of ammonia decomposition by adding controlled amounts of air to the raw coal gas 4 obtained at the expansion ratios by the expansion turbine shown in Table 3, and heating the raw coal gas to a temperature of 800° C., the same temperature as the outlet temperature of the gasification furnace, by partial combustion of the raw coal gas with the added air are shown, where a combustion ratio of the combustible gas in the raw coal gas 4 and the concentration of remaining ammonia in the clean gas 5 from the ammonia decomposition reactor 36 are also given.

As is evident from Table 4, the effect of adding air to the raw coal gas 4 and partially combusting the raw coal gas with the added air to increase the temperature of the raw coal gas is effective for the ammonia decomposition, and the concentration of remaining ammonia can be lowered to about 70 ppm only by utilizing 6% of the combustible gas in the raw coal gas. This effect will be also clear from FIG. 2 by referring to points (5), (6), (7) and (8), each of which corresponds to Run No. 5, 6, 7 and 8 in Table 4.

The concentration of remaining ammonia can be further lowered by increasing the amount of the combustible gas to be utilized, that is, the combustion ratio. On the other hand, even if the combustible gas is combusted before the combustor for the gas turbine, the heat of combustion can be all utilized to increase the sensible heat of the raw coal gas without any heat loss, and thus the overall heat efficiency of the entire power generation system is not changed at all thereby.

TABLE 4

| Run No. | Expansion ratio | Combustion ratio | Condition | Line No. 4 | 4' | 5 |
|---|---|---|---|---|---|---|
| | | | Pressure (kg/cm$^2$) | 15 | 15 | 15 |
| 5 | 1.33 | 1.3% | Temperature (°C.) | 756 | 800 | 800 |
| | | | $NH_3$ (ppm) | 10,000 | 10,000 | 220 |
| | | | Pressure (kg/cm$^2$) | 10 | 10 | 10 |
| 6 | 2.0 | 3.2% | Temperature (°C.) | 694 | 800 | 800 |
| | | | $NH_3$ (ppm) | 10,000 | 10,000 | 150 |
| | | | Pressure (kg/cm$^2$) | 7.5 | 7.5 | 7.5 |
| 7 | 2.67 | 4.4% | Temperature (°C.) | 655 | 800 | 800 |
| | | | $NH_3$ (ppm) | 10,000 | 10,000 | 110 |
| | | | Pressure (kg/cm$^2$) | 5.0 | 5.0 | 5.0 |
| 8 | 4.0 | 5.9% | Temperature (°C.) | 605 | 800 | 800 |
| | | | $NH_3$ (ppm) | 10,000 | 10,000 | 73 |

In the foregoing Tables 3 and 4, data of pressure reduction only down to 5 kg/cm$^2$ are shown, because the pressure reduction down to about 5 kg/cm$^2$ can be regarded as practically suitable for the clean gas for combustion in the succeding combustor for gas turbine in view of correlations among the compression ratio of air to be supplied to the succeding combustor, compression efficiency, expansion ratio in gas turbine, and efficiency, and also relation to the ammonia decomposition temperature. However, when the raw coal gas is expanded to the atmospheric pressure, heated to about 810° C. and led to the ammonia decomposition reactor, the concentration of remaining ammonia can be reduced to less than 45 ppm, as described above.

According to the embodiment shown in FIG. 3, the pressure and temperature of a raw coal gas can be effectively controlled and the removal of tarry matter, hydrogen sulfide and ammonia from a high temperature, high pressure raw coal gas can be carried out with a good efficiency, and also the pressure reduction of the raw coal gas in the expansion turbine can be directly converted to an electric energy, which thus can make the purification of a high temperature, high pressure raw coal gas more effective.

According to another embodiment of the present invention shown in FIG. 4, the purification of raw coal gas can be attained at a lower concentration of remaining ammonia meeting the more strict therefor requirements for gas turbine purpose together with both very high purification efficiency and heat efficiency by providing a simple oxidation heater in addition to the effects obtained in the embodiment of the present invention shown in FIG. 3.

In FIG. 5, further embodiment of the present invention is shown, which differs from the embodiment shown in FIG. 3 in the following points:

In the embodiment of the present invention shown in FIG. 3, the tar remover 31, the tar combustor 32, and the cooler 33 are both of moving bed types, and the alumina particles are moved recyclically among these units, whereas in the embodiment of the present invention shown in FIG. 5, the tar remover 31, the tar combustor 32 and the cooler 33 are all of fluidized bed type, and the alumina particles are successively and recyclically moved among these units. That is, a raw coal gas leaving a coal gasification furnace (not shown in the drawing) enters into a tar remover 31, and it is subjected to temperature lowering and removal of tarry matter therein, and then led to a desulfurizer reactor 34 through a line 2, where hydrogen sulfide is removed from the raw coal gas through reaction with solid absorber particles of, or containing iron oxide placed therein, and leaves the reactor as a raw coal gas 3 after the desulfurization. The raw coal gas 3 is pressure-reduced to the atmospheric pressure through an expansion turbine 41, heated through a heating pipe 37 by the heat of combustion of the tarry matter to a temperature suitable for the ammonia decomposition reaction, and led to an ammonia decomposition reactor 36, where ammonia in the raw coal gas is decomposed by a catalyst containing iron in a state of reduced iron, and a clean gas 5 is obtained. Alumina particles having a lower temperature than that of the raw coal gas 1 are supplied to the tar remover 31 to effect cooling of the raw coal gas and removal of tarry matter therefrom. The alumina particles with the tarry matter recovered thereon are led to a tar combustor 32 through a line 22, where the tarry matter is burned with heated air from line 13 in a fluidized bed state of the alumina particles to heat the raw coal gas 3 passing through heating pipe 37. The alumina particles freed from the tarry matter by burning are led to a cooler 33 through a line 23, and cooled by air 11 to a lower temperature than that of the raw coal gas 1 and recycled to the tar remover 31 through the line 21.

Air 11 is heated through contact with the alumina particles in a fluidized bed state in the cooler 33, passed through a line 12, heated in a heat exchanger 40 with the effluent combustion gas from the tar combustor, and led to the tar combustor 32 through a line 13.

In the embodiment of the present invention shown in FIG. 5, where the same raw coal gas at 800° C. leaving the coal gasification furnace and having the same composition as in Table 2 is used as the raw coal gas 1, one operation condition is such that the same operating performances as in the embodiment of the present invention shown in FIG. 3 can be obtained with the percent removals of both hydrogen sulfide and ammonia of more than 99%, and also a clean gas at 800° C. can be obtained.

In FIG. 6, another embodiment of the present invention is shown, which differs from the embodiments shown in FIGS. 3 and 5 in the following points:

In the embodiments shown in FIGS. 3 and 5, the temperature of raw coal gas is cooled to a temperature suitable for the hydrogen sulfide removal reaction through continuous contact with the solid particles having a lower temperature than the outlet temperature of the raw coal gas from the gasification furnace and at the same time the tarry matter is recovered from the raw coal gas on the solid particles, whereas in the embodiment shown in FIG. 6, the raw coal gas is more deeply cooled with a cooling pipe in the presence of the solid particles to recover the tarry matter to a higher degree.

In FIG. 6, a raw coal gas 1 enters into a tar remover 31 provided with a cooling pipe 45 therein, through which water is passed as a cooling medium, and the raw coal gas is cooled by the cooling pipe, as well as contact with the alumina particles in a fluidized bed state to a temperature suitable for the hydrogen sulfide removal reaction. At the same time the tarry matter contained in the raw coal gas is recovered on the alumina particles by condensation and deposition. The sensible heat and the latent heat of the temperature lowering of the raw coal gas and the condensation of tarry matter are recovered by converting the water 16 passing through the cooling pipe 16 to steam 17. The raw coal gas in line 2 leaving the tar removal 31 enters into a desulfurizer reactor 34, where the raw coal gas is contacted with solid absorber particles of, or containing iron oxide in a fluidized bed state to remove hydrogen sulfide contained therein, and leaves the reactor 34 as a desulfurized raw coal gas 3. The raw coal gas is pressure-reduced to the atmospheric pressure by an expansion turbine 41.

The alumina particles with the tarry matters deposited thereon are taken to a tar combustor 32, where the tarry matter on the alumina particles are burned in a fluidized bed state with hot air from line 13 to heat the raw coal gas 3 leaving the desulfurization and expansion steps through a heating pipe 37 provided in the tar combustor 32 to a temperature suitable for ammonia decomposition reaction. The alumina particles regenerated by the removal of the tarry matter by burning are returned to the tar remover 31 through a line 22, and reused to recover the tarry matters from the raw coal gas. Combustion gas 14 leaving the tar combustor 32 heats air 11 for burning the tarry matter through a heater 40 to provide the hot air in line 13.

The raw coal gas 4 heated to the temperature suitable for the ammonia decomposition reaction enters into an ammonia decomposition reactor 36 filled with a catalyst containing iron in a state of reduced iron, where the ammonia contained in the raw coal gas is decomposed to obtain a clean gas 5. The regeneration of the absorber particles for desulfurization can be carried out in the same manner as described before referring to the embodiment of FIG. 3.

When a raw coal gas at 800° C. having the same composition as in Table 2 is used as the raw coal gas 1 in the embodiment shown in FIG. 6, the raw coal gas in line 2 is cooled to 635° C. and contains the remaining uncondensed tarry matter in about 12 g/Nm$^3$ with more than 60% of the tarry matter being recovered on the alumina particles. Raw coal gas 3 after the desulfurization has a temperature nearly same as 635° C. with less than 30 ppm of remaining hydrogen sulfide, that is, more than 99% of hydrogen sulfide is removed. The raw coal gas after the desulfurization and expansion is heated to 800° C. by burning of the tarry matter, and a concentration of remaining ammonia in the clean gas is less than 50 ppm, and more than 99% of ammonia is decomposed.

In FIG. 7, still further embodiment of the present invention is shown, where a modification is made to a part of the embodiment of FIG. 6 to remove a much larger amount of the tarry matter from the raw coal gas by cooling the raw coal gas to a lower temperature in the tar remover. The temperature of the raw coal gas leaving the tar remover is lower than that in FIG. 6, and thus an additional heater is provided to heat the raw coal gas to a temperature suitable for the removal of hydrogen sulfide. That is, the embodiment of FIG. 7 is different from that of FIG. 6 only in the following point.

The raw coal gas leaving the tar remover 31 at a lower temperature is heated to a temperature suitable for the hydrogen sulfide removal reaction through heat exchange with a combustion gas leaving a tar combustor 32 through a heater 44 before being led to a desulfurizer reactor 34. That is, when a raw coal gas having the same composition as in Table 2 is contacted with alumina particles and simultaneously cooled by water passing through a cooling pipe 45° to 400° C., most of the tarry matter contained in the raw coal gas 1 are condensed and deposited on the alumina particles, that is, 90% of the tarry matter in the raw coal gas 1 is deposited onto the alumina particles.

The raw coal gas leaving the tar remover 31 is led to the heater 44 and heated to a suitable temperature, 635° C., for the hydrogen sulfide removal through heat exchange of the combustion gas produced by burning of the tarry matter in a tar combustor 32, and then led to a desulfurizer reactor 34. A raw coal gas 3 containing 40 ppm of remaining hydrogen sulfide at 650° C. leaves the reactor 34 and is pressure-reduced to the atmospheric pressure by an expansion turbine 41, and then heated to 800° C. by passing through a heating pipe 37 in a tar combustor 32 by the heat of combustion of the tarry matter. The resulting raw coal gas 4 is led to an ammonia decomposition reactor 36, where almost all of the ammonia is decomposed, and a clean gas 5 having 45 ppm of residual ammonia at about 800° C. is obtained. The clean gas is harmless, and more than 99% of hydrogen sulfide and ammonia are removed.

The solid particles used for recovering the tarry matter in the present invention are not limited to alumina particles and a mixture of alumina and silica particles, and also the present invention is not limited to the embodiments of processes and apparatuses described in the foregoing. For example, the ammonia decomposition reactor can be used in combination with a regenerator reactor for the ammonia decomposition catalyst, and the work the energy obtained expansion in the turbine can be converted to a mechanical energy in addition to the electric energy.

As described above, the most suitable conditions of temperature and pressure for the removal of hydrogen sulfide and ammonia can be attained in the present invention by effectively utilizing the tarry matter contained in a raw coal gas without any tar problem and without requiring any heat source from the outside, and the removal of hydrogen sulfide and the ammonia decomposition can be carried out with a very high efficiency, and the energy obtained by the gas expansion in the turbine can be converted to an electric energy or mechanical energy, utilizing the energy possessed by the raw coal gas effectively. In the present invention, the raw coal gas can thus be purified by removing the harmful components effectively with a very high energy efficiency and a high stability.

What is claimed is:

1. A process for purifying a high pressure raw coal gas having a temperature in the range of 800° C. or greater and containing tarry matter, hydrogen sulfide and ammonia, which comprises:

contacting the raw coal gas with solid particles having a lower temperature than the raw coal gas, thereby cooling the raw coal gas to a temperature in the range of 550°-800° C., and thereby simultaneously removing tarry matter from the raw coal gas by condensing and depositing the tarry matter on the solid particles;

thereafter contacting the raw coal gas having a temperature within the range of 550°-800° C., from which the tarry matter has been removed, with solid particles that will absorb hydrogen sulfide to thereby remove the hydrogen sulfide from the raw coal gas;

burning the removed tarry matter to produce heat of combustion;

thereafter heating the raw coal gas, from which the tarry matter and hydrogen sulfide have been removed, to a temperature in the range of 700°-900° C. with the heat of combustion produced by the burning of the removed tarry matter; and thereafter contacting the raw coal gas at a temperature within the range of 700°-900° C. from which the tarry matter and hydrogen sulfide have been removed, with an ammonia decomposition catalyst to decompose and remove ammonia.

2. A process according to claim 1, wherein the solid particles with the tarry matter deposited thereon, after being used for cooling the raw coal gas to the temperature suitable for the reaction of removal of hydrogen sulfide, are contacted with hot air to burn the tarry matter and regenerate the solid particles for reuse in recovering tarry matter from the raw coal gas.

3. A process according to claim 1, wherein the raw coal gas is contacted with solid particles cooled by air to a temperature lower than that of the raw coal gas, thereby cooling the raw coal gas to a temperature in the range of 550°-800° C. while simultaneously recovering tarry matter contained in the raw coal gas on the solid particles by condensation and deposition, the solid particles with the tarry matter deposited thereon are regenerated by burning the tarry matter on the solid particles, and the regenerated particles are cooled through contact with air, and reused in cooling the raw coal gas and recovering tarry matter from the raw coal gas.

4. A process according to claim 1, wherein the raw coal gas is cooled to a temperature within the range of 550°-800° C. by contact with a cooling pipe in the presence of the solid particles, thereby simultaneously recovering tarry matter on the solid particles by condensation and deposition, the raw coal gas freed from hydrogen sulfide is heated to a temperature in the range of 700°-900° C. by the heat of combustion produced by burning the tarry matter deposited on the solid particles, thereby regenerating the solid particles, and the regenerated solid particles are reused in recovering tarry matter from the raw coal gas.

5. A process according to claim 1, wherein the raw coal gas is further cooled by contact with a cooling pipe in the presence of the solid particles, thereby substantially removing tarry matter in the raw coal gas by condensing and depositing the tarry matter on the solid particles, and the cooled raw coal gas is thereafter heated to a temperature in the range of 550°-800° C.

6. A process according to claim 5, wherein the cooled raw coal gas is heated to a temperature within the range of 550°-800° C. by the heat of combustion produced by burning the tarry matter deposited on the solid particles.

7. A process according to claim 5, wherein the solid particles with the tarry matter deposited thereon by condensation are contacted with hot air and burned, thereby regenerating the solid particles for reuse in recovering tarry matter from the raw coal gas.

8. A process according to claim 1, wherein the pressure of the raw coal gas freed from hydrogen sulfide is reduced, and then the raw coal gas is heated to a temperature within the range of 700°-900° C.

9. A process according to claim 8, wherein the pressure of the raw coal gas freed from hydrogen sulfide is reduced by expansion.

10. A process according to claim 9, wherein the energy produced by the expansion of the raw coal gas is converted to power.

11. A process according to claim 8, wherein the raw coal gas freed from hydrogen sulfide and after the pressure reduction and the heating, is admixed with air, and a portion of combustible gases therein is combusted by oxidation thereby heating the raw coal gas to a temperature within the range of 700°-900° C.

12. A process according to claim 1, wherein the hydrogen sulfide removal reaction is carried out by contacting the raw coal gas with solid absorber particles of or containing iron oxide and the ammonia decomposition reaction is carried out by contacting the raw coal gas with a catalyst containing iron in a state of reduced iron.

13. A process according to claim 1, wherein the solid particles are alumina particles or a mixture of alumina particles and silica particles.

14. A process according to claim 12, wherein the hydrogen sulfide removal reaction is carried out at a temperature of 550° to 800° C., and the ammonia decomposition reaction at a temperature of 700° to 900° C. under a pressure of not more than 15 kg/cm$^2$.

15. A process according to claim 14, wherein the hydrogen sulfide removal reaction is carried out at a temperature of 600° to 750° C.

16. A process according to claim 15, wherein the hydrogen sulfide removal reaction is carried out at a temperature of 650° C.

* * * * *